United States Patent [19]

Bearden et al.

[11] Patent Number: 4,537,676

[45] Date of Patent: Aug. 27, 1985

[54] REDUCING METAL CONTENT OF OIL FEEDS

[75] Inventors: Roby Bearden; Gordon F. Stuntz, both of Baton Rouge, La.

[73] Assignee: Exxon Research and Engineering Co., Florham Park, N.J.

[21] Appl. No.: 336,785

[22] Filed: Jan. 4, 1982

Related U.S. Application Data

[63] Continuation-in-part of Ser. No. 221,844, Dec. 31, 1980, abandoned.

[51] Int. Cl.[3] ..... C10G 17/06; C10G 29/10

[52] U.S. Cl. ..... 208/251 R; 208/252; 208/253; 208/348

[58] Field of Search ..... 208/251 R, 252, 253, 208/348

[56] References Cited

U.S. PATENT DOCUMENTS

| | | | |
|---|---|---|---|
| 2,009,710 | 7/1935 | Goodwin et al. | 208/252 |
| 2,411,958 | 12/1946 | Dietrich et al. | 208/251 |
| 2,926,129 | 2/1960 | Kimbertem | 208/86 |
| 2,969,320 | 1/1961 | Shapiro | 208/251 |
| 3,095,368 | 6/1963 | Bieber | 208/252 |
| 3,294,678 | 12/1966 | Gleim | 208/309 |
| 3,511,774 | 5/1970 | Long et al. | 208/251 R |
| 4,035,287 | 7/1977 | Espenscheid et al. | 208/242 |

FOREIGN PATENT DOCUMENTS 2031011 4/1980 United Kingdom .

OTHER PUBLICATIONS

The Oil and Gas Journal, May 15, 1972, "Deposited Metals Poison FCC Catalyst", Cumbalo et al.

"Physical Properties of Chemical Compounds-III", No. 29, Advances in Chemistry Series, American Chemical Society, Washington, DC, (1961), pp. 5 & 472.

*Primary Examiner*—D. E. Gantz

*Assistant Examiner*—Helane Myers

*Attorney, Agent, or Firm*—Edward M. Mazer

[57] ABSTRACT

A method for reducing the concentration of metal contaminants, such as vanadium and nickel, in the distillate from a petroleum fraction is disclosed. The method comprises contacting the petroleum fraction in a contacting zone with an effective amount of sulfur dioxide of a sulfur dioxide precursor at a temperature ranging between about 200° C. and 450° C. for a period of time ranging between about 0.01 and 5 hours after which the fraction is passed to a vacuum separation zone and separated into a distillate having a relatively low metals content and a bottoms having a relatively high metals content.

16 Claims, 6 Drawing Figures

REDUCING METAL CONTENT OF OIL FEEDS

CROSS-REFERENCE TO RELATED APPLICATION

This application is a continuation-in-part of U.S. patent application Ser. No. 221,844, filed Dec. 31, 1980, now abandoned.

BACKGROUND OF THE INVENTION

The present invention generally relates to the removal of metallic contaminants from petroleum fractions. Specifically, the present invention relates to the removal of complex organo-metallic compounds, for example, of the porphyrin type, and particularly those compounds containing nickel and vanadium from high boiling petroleum gas oils.

Petroleum gas oils normally contain iron, nickel, vanadium and other metallic contaminants which have an adverse effect upon petroleum processing operations. As the cut point, the atmospheric equivalent of the highest boiling material in the distillate increases, the fraction of the feed recovered as distillate increases. However, as the cut point is elevated, the metal concentration in the distillate also increases. In petroleum processing operations such as catalytic cracking the presence of these metallic contaminants in the petroleum feed leads to rapid catalyst contamination by metals causing an undesirable increase in the hydrogen and coke makes, a loss in gasoline yield, a loss in conversion activity and a decrease in the catalyst life. The metal contaminant concentration generally is higher in the heavier feedstocks. Thus, the removal of metal contaminants is becoming more important as increasingly heavy feedstocks are being refined and as additional efforts are being directed at upgrading the residual petroleum fractions.

In the past, efforts have been directed at the removal of metal contaminants from petroleum fractions by a variety of methods including deasphalting processes, hydrotreating processes and HF extraction. U.S. Pat. No. 2,926,129 is directed at the removal of organo-metallic compounds and the deasphalting of a petroleum fraction by heating the petroleum fraction at a temperature of 650°–850° F. for 0.1 to 5 hours after which the fraction is contacted with an acidic material soluble in the petroleum fraction, such as HCl, to coagulate the metallic contaminants. A sludging component such as liquid $SO_2$ is then added to the petroleum fraction at the rate of 0.1 to 3 volumes of $SO_2$ per volume of oil to promote precipitation of the asphaltene. A solvent also is added to the fraction preferably at the rate of 0.1 to 10 volumes per volume of oil to separate the asphaltene sludge fraction in a fractionating tower operated at temperatures of 30° to 300° F. and pressures of 25 to 500 psig. This patent also discloses in a table in column 5 that a less effective reduction in metals content in the recovered oil may be accomplished utilizing the solvent and liquid $SO_2$, without the acid. Use of the process described in this patent is not desirable, since relatively large quantities of sulfur dioxide in the liquid state are required, which necessitates operating at high vessel pressures and may require the removal of the $SO_2$ from the recovered oil. Moreover, addition of an acid, such as HCl, would require that the processing equipment be acid resistant. In addition, the presence of acidic compounds in the recovered oil would be injurious to catalysts used in subsequent processing. Furthermore, the presence of halogen compounds in the system increases the potential for downstream corrosion, particularly if water should be present. Moreover, the subsequent deasphalting operations require the addition of a solvent and the precipitation and filtration of the asphaltenic fraction from the petroleum feed.

U.S. Pat. No. 3,294,678 is directed at a deasphalting process for the separation and removal of asphaltenic material including organo-metallic complexes of nickel and vanadium which comprises treating the petroleum fraction with an alkalinous bisulfide or bisulfite in aqueous solution under a pressure in the range of 150 to 2000 psig in the presence of sufficient sulfur dioxide such that the partial pressure of the sulfur dioxide is within the range of about 150 to about 1500 psig. The asphaltenic material including organo-metallic compounds is converted into a water-soluble sulfonic acid salt which is extracted. This process is not desirable because of the additional steps of separating the water fraction from the petroleum fraction and subsequently separating the sulfonic acid salts from the asphaltenic material.

U.S. Pat. No. 2,969,320 discloses a method for removing tetraethyl lead from gasoline and other hydrocarbon liquids by injecting sulfur dioxide into the liquid to form an insoluble lead sulfide which may subsequently be removed by filtration. This method does not disclose or suggest removal of metals such as nickel and vanadium from petroleum fractions by heating in the presence of sulfur dioxide prior to distillation.

U.S. Pat. No. 3,095,368 describes a method for selectively removing iron, nickel and vanadium from an asphaltic petroleum feedstock by deasphalting the oil and subsequently contacting the oil with a mineral acid to coagulate the metallic compound. The metallic compounds are then separated. This process requires the use of mineral acids which are corrosive and requires additional processing steps.

In a paper presented at the 1980 meeting of the Division of Petroleum Chemistry of the American Chemical Society, Bukowski and Gurdzinska disclosed a method for reducing the adverse catalytic effect of metal contaminants present in the distillate from atmospheric residuum. The method included the heat treating of the atmospheric residuum in the presence of cumene hydroperoxide (CHP) for up to six hours at 120° C. This step increased the distillate fraction obtained from the atmospheric residuum feed and decreased the metals content of the distillate which subsequently was used as feed for a catalytic cracking unit. This procedure is not advantageous due to the relatively high cost of the CHP required.

British patent application No. 2,031,011 describes a method for reducing the metals and asphaltene content of a heavy oil by hydrotreating the oil in the presence of a catalyst including a metal component from Group Ib, IIb, IIIa, Va, VI, and VIII of the periodic table followed by deasphalting. This process is not preferred since relatively large quantities of hydrogen are required in addition to a large investment for hydrotreating process equipment.

Accordingly, it is desirable to provide a process which reduces the metals concentration in a petroleum fraction to sufficiently low levels without the addition of large amounts of acidic materials.

It also is desirable to provide a process in which the metals content of a petroleum fraction is reduced without the addition of a halogenated compound.

It is also advantageous to provide a process which will reduce the metals concentration in the petroleum fraction without an excessive amount of equipment and without the addition of a large number of additional processing operations.

It is also desirable to provide a process which will reduce the metals concentration in a petroleum fraction without the further addition of solvent.

SUMMARY OF THE INVENTION

The subject invention is directed at a method for reducing the metal contaminant concentration in the distillate from a petroleum fraction containing the metal contaminant comprising the steps of:

A. passing the petroleum fraction containing the metal contaminant into a contacting zone maintained at a temperature ranging between about 200° C. and about 450° C. and contacting the petroleum fraction therein with an effective amount of one or more metal devolatilization agents selected from the group consisting of sulfur dioxide and precursors of sulfur dioxide including sulfurous acid, ammonium bisulfite and alkali metal bisulfites; and, B. passing the petroleum fraction from the contacting zone into a vacuum separation zone wherein the petroleum fraction is separated into a distillate having a relatively low metal contaminant concentration and a bottoms having a relatively high metal contaminant concentration. In a preferred embodiment the petroleum fraction, comprising atmospheric distillation column bottoms, is passed into a contacting zone maintained at a temperature ranging between about 250° C. and 400° C. for about 0.01 to about 5 hours, said contact time generally varying inversely with temperature in the presence of about 0.5 to about 5.0 weight percent of sulfur dioxide, based upon the weight of the petroleum fraction. The petroleum fraction is then transferred from the contacting zone to a vacuum distillation column where the fraction is separated into a distillate relatively low in metals content having a cut point of at least about 520° C. at atmospheric pressure, preferably at least about 565° C. and most preferably at least about 590° C. and a bottoms having a relatively high metals content.

DETAILED DESCRIPTION OF THE INVENTION

FIGS. 1–5 graphically illustrate the importance of reducing the nickel and vanadium content of distillates produced from petroleum fractions, particularly residual fractions.

Generally, vanadium is considered to exhibit about one-quarter of the adverse catalytic effect of nickel on a weight equivalent basis. The adverse catalytic effect of nickel and vanadium is discussed in an article by Cimbalo, Foster and Wachtel in "Oil and Gas Journal" May 15, 1972, pages 112–122, the disclosure of which is incorporated herein by reference.

Figure 1:
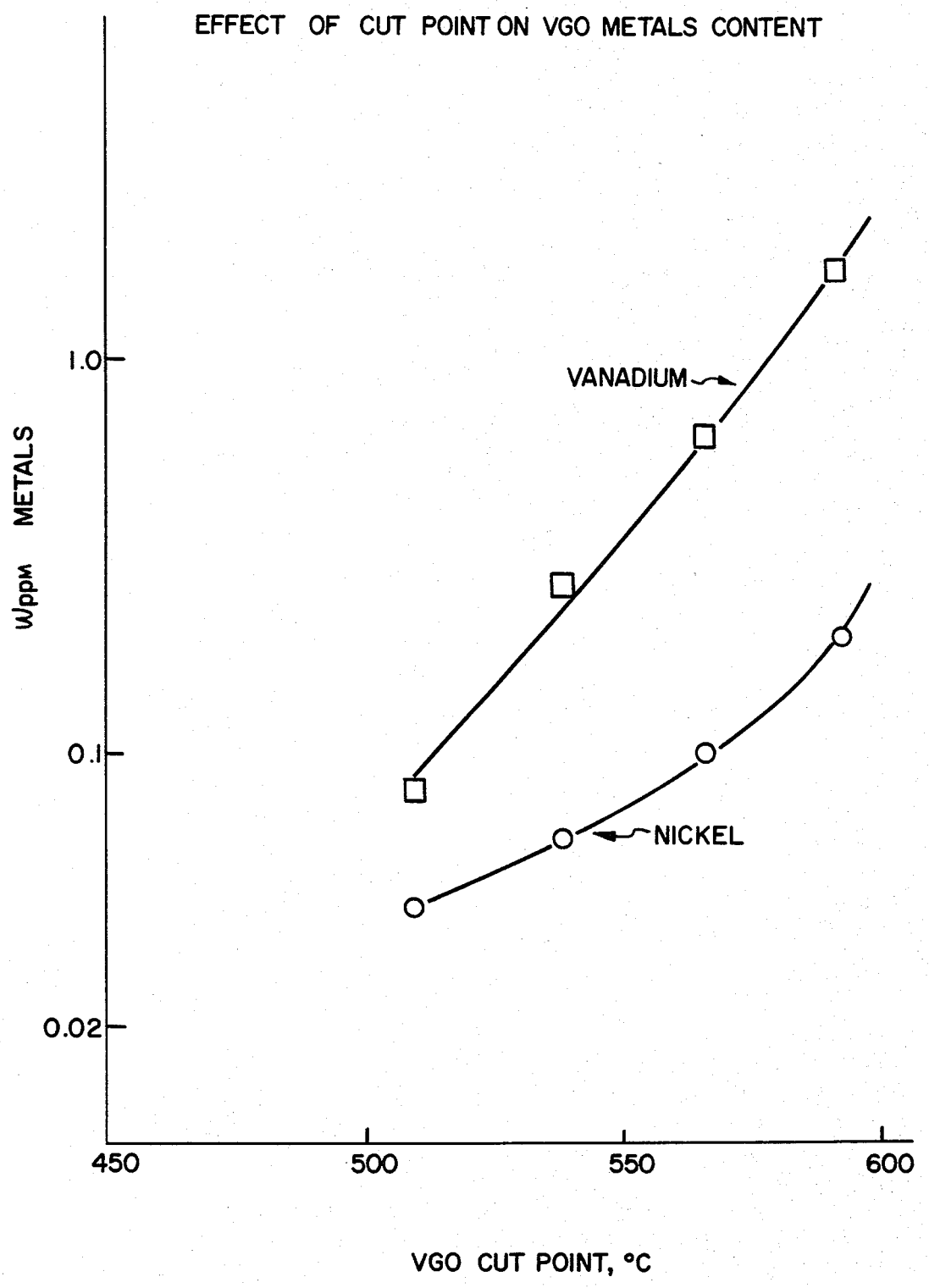
FIG. 1 is a plot of nickel and vanadium content in a distillate produced from a typical heavy feed as a function of the cut point.

FIG. 1 illustrates the increase in vanadium and nickel content of the distillate from a typical residual petroleum fraction as a function of the cut point where the subject invention has not been practiced. Typically, in the production of vacuum gas oils, the cut point is limited to a maximum temperature of approximately 565° C. Above this temperature the metals concentration in the distillate increases sharply as shown by the curves for the nickel and vanadium concentrations.

Figure 2:
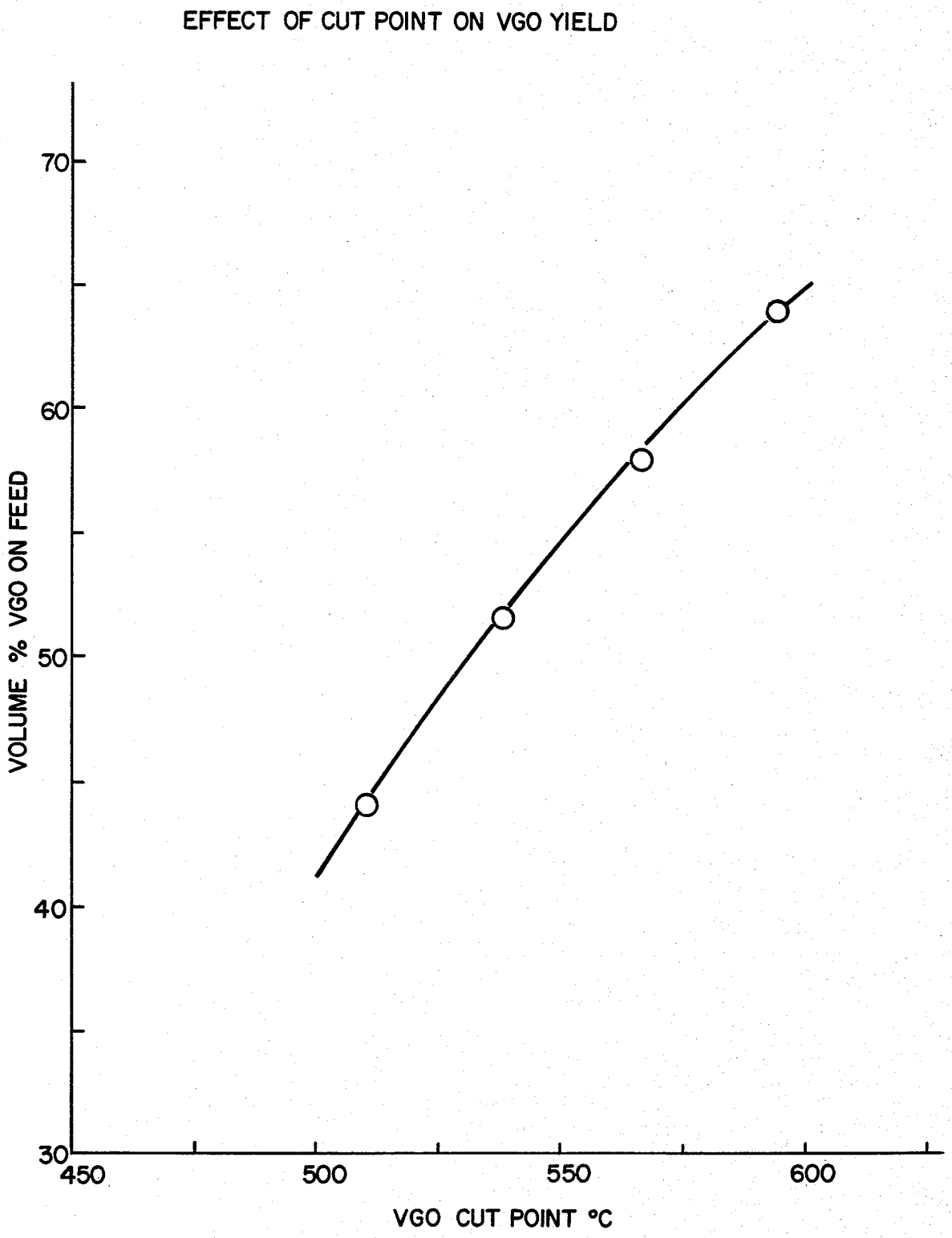
FIG. 2 illustrates the volume percent of a typical feed which is distilled as a function of the cut point.

FIG. 2 illustrates the percent of a typical heavy petroleum feed which is distilled into a vacuum gas oil distillate as a function of the cut point. It should be noted that, as the cut point increases, the volume percent of the feed recovered as distillate increases. Use of the subject invention results in reduced metals content in the distillate at a given cut point or increased yield with substantially the same metals content utilizing a higher cut point.

Figure 3:
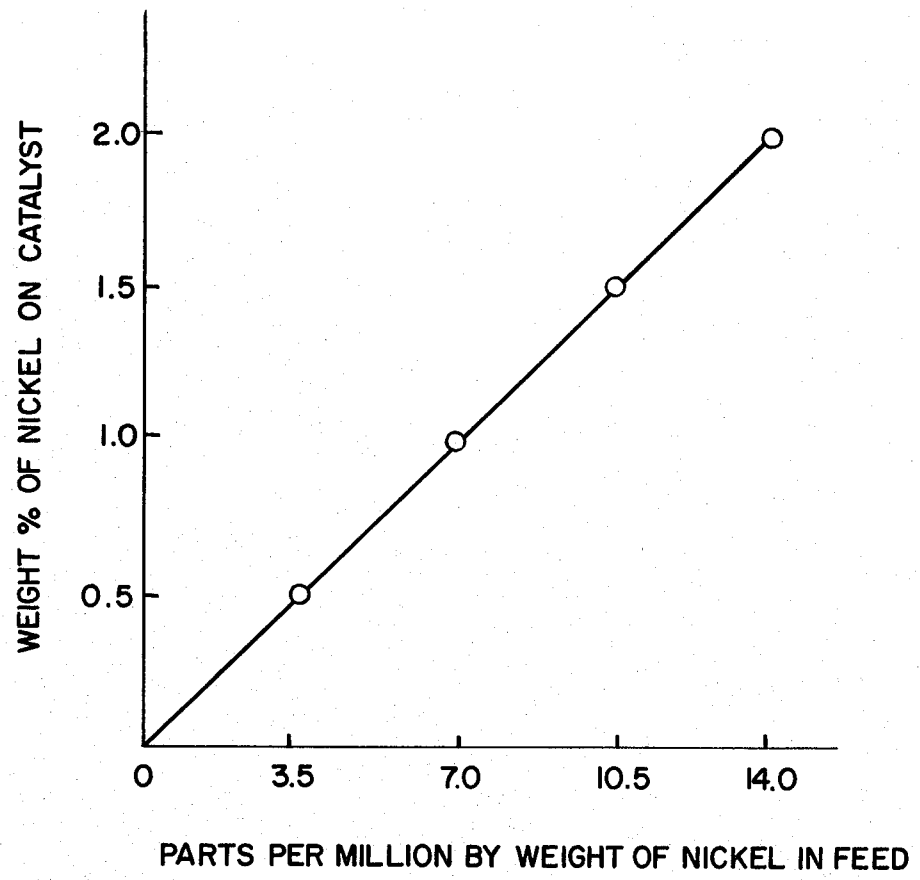
FIG. 3 is a plot of the weight percent of the nickel on the catalyst as a function of the parts per million by weight of nickel in the feed.
Figure 5:
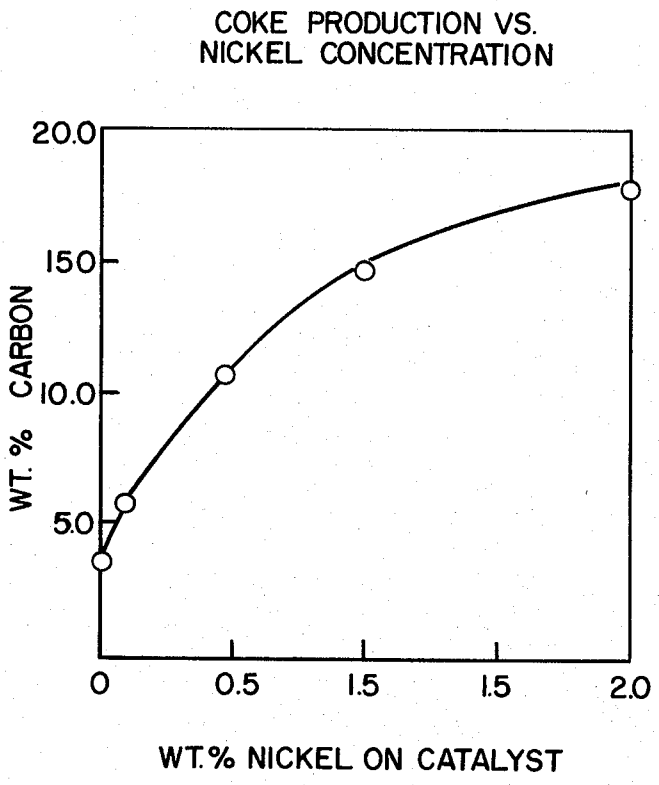
FIG. 5 is a plot of the weight percent of the feed which is converted to coke as a function of the nickel content on the catalyst under typical catalytic cracking operating conditions.
Figure 4:
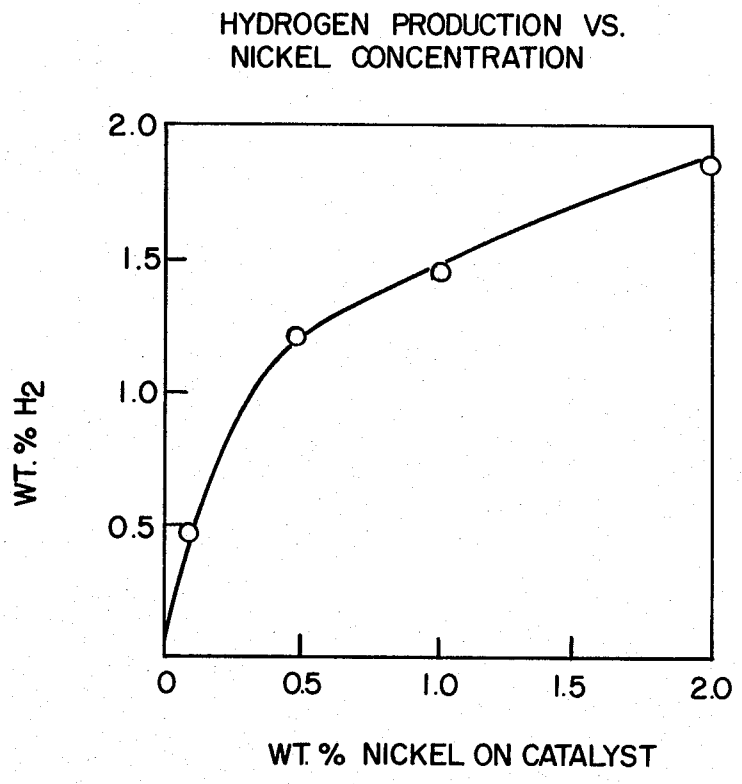
FIG. 4 is a plot of the weight percent of the feed which is converted to hydrogen as a function of the nickel content of the catalyst under typical catalytic cracking conditions.

The detrimental effects of nickel on petroleum processing may be seen from FIGS. 3, 4 and 5. FIG. 3 illustrates the relationship between the nickel content of the feed and the corresponding nickel content of the catalyst obtained under typical catalytic cracking conditions. FIG. 4 illustrates the weight percent of the feed converted to hydrogen as a function of the nickel concentration on the catalyst. FIG. 5 illustrates the weight percent of the feed converted to coke as a function of the nickel content on the catalyst. Vanadium and other metals, such as iron and copper may also be present in petroleum fractions. These metals are less catalytically active, but also may contribute to excessive hydrogen and coke production. As used herein the term "metal contaminant" is defined to include all of the aforementioned metals. In the test data shown in FIGS. 4 and 5 a commercially available silica-alumina zeolite catalyst sold under the trade name CBZ-1, manufactured by Davison Division, W. R. Grace and Company was used. The CBZ-1 catalyst used was first steamed at 760° C. for 16 hours after which the catalyst was contaminated with the indicated metals by laboratory impregnation, followed by calcining at about 540° C. for four hours. Tests were run using a microcatalytic cracking (MCC) unit. The MCC unit comprised a captive fluidized bed of catalyst kept at a cracking zone temperature of 500° C. Tests were run by passing a vacuum gas oil having a minimum boiling point of about 340° C. and a maximum boiling point of about 565° C. through the reactor for two minutes and analyzing for hydrogen and coke production. It can be seen that as the nickel concentration on the catalyst increases, the undesired hydrogen and coke yields also increase. Thus, it can be appreciated that a process which would devolatilize the metals present in the petroleum fraction, i.e. retain a greater fraction of the metals in the bottoms than currently practiced processes, would have applicability in increasing the distillate yield from petroleum fractions and in improving the quality of the resulting distillate.

Figure 6:
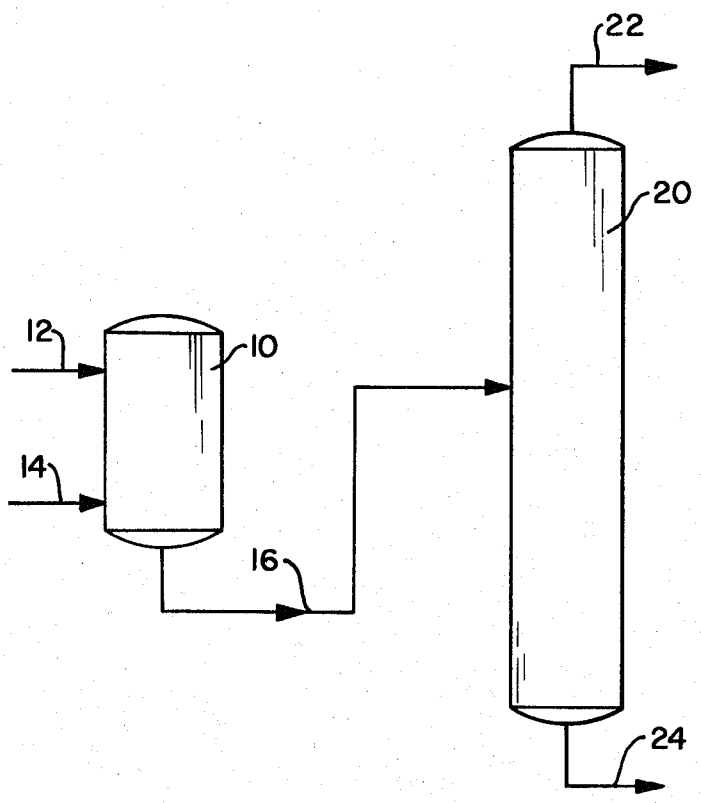
FIG. 6 is a simplified process flow diagram illustrating one method for practicing the subject invention.

Referring to FIG. 6, one method for practicing the subject invention is shown. In this figure valves, pumps, piping, instrumentation and equipment not essential to the understanding of the subject invention have been eliminated for clarity. A petroleum fraction is shown entering contacting zone 10 through line 12. A metal devolatilization agent is added to zone 10 through line 14. Typically contacting zone 10 will comprise a process vessel whose size is a function of the feed rate through line 12 and the desired residence time. After the requisite residence time in zone 10 the petroleum fraction is transferred through line 16 to a vacuum separation zone 20 in which the feedstock is separated into a distillate 22 and a bottoms product 24.

The composition of the petroleum feedstock passed into the contacting zone is not critical. Typically, this will comprise the bottoms from an atmospheric distillation having an initial atmospheric boiling point of at least about 285° C. which has a total elemental metals contaminant content ranging between about 1 and about 2000+ parts per million by weight (wppm), although other metals containing feedstocks may also be used. To avoid unnecessary contamination of the distillate and bottoms as well as to minimize costs, the amount of metal devolatilization agent used should be the lowest amount which will give effective metal devolatilization at the desired operating conditions. The amount of metal devolatilization agent required will be a function of the specific agent used and the metals content of the feed. The devolatilization agent, selected from the group consisting of sulfur dioxide and sulfur dioxide precursors such as sulfurous acid, ammonium bisulfite and alkyl metal bisulfites, preferably is a non-halogen compound. The most preferred devolatilization agent, based upon cost and effectiveness, is sulfur dioxide which, preferably, is present in the contacting zone as a vapor. Typically, the concentration of $SO_2$ added to the high metals feed will range from about 0.5 to about 5.0 wt.% of the feed, preferably between about 1 and 3 wt.%. If a precursor of $SO_2$ is used, the precursor concentration should be sufficient to furnish $SO_2$ concentrations of from about 0.5 to about 5.0 wt.% of the feed and preferably from about 1 to about 3 wt.% $SO_2$.

The residence time of the petroleum fraction in contacting zone 10 must be sufficient to provide sufficient contacting between the metal devolatilization agent and the petroleum fraction. The residence time in zone 10 is a function of the specific metal devolatilization agent utilized, the process conditions in zone 10 and the metal contaminant content of the fraction. Typically, the residence time in zone 10 will range between about 0.01 and about 5 hours. The temperature in zone 10 may range between about 200° C. and about 450° C., preferably between about 250° C. and 400° C. while the pressure may range between about 20 and about 400 psig, preferably between about 50 and 200 psig. Vacuum separation zone 20, generally comprising a distillation column may be of conventional design. The specific operating conditions are a function of the feed composition entering through line 16 and the desired distillate composition exiting through line 22. The design of the distillation column is not critical and would be determined by conventional design techniques. Typically, the absolute pressure measured at the top of zone 20 will range between about 10 and about 100 mm Hg, and the temperature at the base of zone 20 will range between about 370° C. and about 450° C. The cut point of the distillate normally will be at least 550° C. and may range as high as 590° C. or above. It should be noted that the process described herein reduces the metals content of petroleum fractions utilizing a non-halogen containing metal devolatilization agent without the addition of large quantities of solvent.

The following examples illustrate the effectiveness of the subject invention in reducing the metals content of a hydrocarbon feed.

EXAMPLE 1

Comparative experiments were made using as feed a Tia Juana atmospheric residuum having an initial boiling point of about 260° C., a nickel content of 34 parts per million by weight (wppm), and a vanadium content of 273 wppm. Results are given in Table 1 below. In this example, sample number one, 300 g. of Tia Juana residuum, was charged to a one liter autoclave of Hastelloy-C construction, along with 6.3 g. (2.1 wt.% on feed) of gaseous sulfur dioxide. The autoclave was then heated to 343° C. for a one hour stirred contact, during which time the pressure reached 125 psig. Upon cooling to 150° C., the pressure was released and the autoclave was flushed with nitrogen while cooling further to room temperature. The resultant treated residuum was then batch distilled at 500 microns vacuum on a column having one theoretical plate to obtain a vacuum residuum bottoms fraction and a vacuum gas oil (VGO) fraction of maximum boiling point 315° C., which corresponds to an atmospheric equivalent boiling point of 565° C. With sample number two, the $SO_2$ pretreatment step was omitted. The Tia Juana residuum feed was distilled in a manner similar to that of sample number 1 to recover a 565° C. atmospheric equivalent boiling point vacuum gas oil and a 565+° C. vacuum residuum bottoms. As can be seen from Table 1, the vacuum gas oil obtained from the $SO_2$ treated sample contained significantly less metals. Expressed in terms of reduction in the equivalent nickel content of the vacuum gas oil (VGO), $SO_2$ treating is seen to give about a 66% reduction in metals content relative to the VGO from the untreated residuum sample.

TABLE I

EFFECT OF $SO_2$ PRETREAT ON REDUCING THE METALS CONTENT OF A 565° C. END POINT VACUUM GAS OIL

| | Sample No. | |
|---|---|---|
| | 1 | 2 |
| Sulfur Dioxide Pretreatment | Yes | No |
| Volume % 565° C. VGO on Feed | 57 | 58 |
| VGO Metals Content | | |
| Nickel, wppm | 0.02 | 0.10 |
| Vanadium, wppm | 0.28 | 0.62 |
| Percent Reduction in Equivalent Nickel* Content of VGO | 66 | — |

*Equivalent Nickel = wppm Nickel + $\frac{\text{wppm Vanadium}}{4}$

EXAMPLE 2

A second set of comparative experiments were made also using a Tia Juana residuum feed identical to that used in Example 1. The $SO_2$ treatment used in the experiment, designated as sample three, was similar to that used in Example 1. However, the vacuum distillation of the treated oil in sample No. 3 and of the untreated feed, designated as sample No. 4, was carried to a higher temperature to isolate a vacuum gas oil of final atmospheric equivalent boiling point of 593° C.

As shown by the data in Table II, the 593° C. cut point VGO obtained from the $SO_2$ treated resid, sample No. 3, contained significantly less metals than the untreated sample, sample No. 4.

TABLE II

EFFECT OF $SO_2$ PRETREAT ON REDUCING THE METALS CONTENT OF A 565° C. END POINT VACUUM GAS OIL

| | Sample No. | |
|---|---|---|
| | 3 | 4 |
| Sulfur Dioxide Pretreatment | Yes | No |
| Volume % 593° C. VGO on Feed | 61 | 64 |
| VGO Metals Content | | |
| Nickel, wppm | 0.13 | 0.20 |
| Vanadium, wppm | 1.00 | 1.70 |
| Percent Reduction in Equivalent Nickel Content of VGO | 40 | — |

EXAMPLE 3

A final test was run to determine if residuum heat soaking in the absence of $SO_2$ would result in a lower metals content in the VGO product. The procedure used was exactly that described for sample No. 4 of Example 2, except that $SO_2$ was omitted and the contact time at 343° C. was extended to two hours in order to give heat soaking the best possible chance to effect a lowering of metals content in the VGO product. After heat soaking, a vacuum distillation was carried out to produce a vacuum gas oil having an atmospheric equivalent boiling point of 593° C. Results are shown in Table III and are compared in the table with the results obtained for sample No. 4 which had no pretreatment at all.

As is apparent from the data, heat soaking alone at 343° C. does not give any appreciable reduction in the metals content of the VGO product.

TABLE III

EFFECT OF HEAT SOAK ON REDUCING THE METALS CONTENT OF A 593° C. END POINT VACUUM GAS OIL

| | Sample No. | |
|---|---|---|
| | 5 | 4 |
| Heat Soak Pretreatment | Yes | No |
| Volume % 593° C. VGO on Feed | 62 | 64 |
| VGO Metals Content | | |
| Vanadium, wppm | 1.36 | 1.70 |
| Nickel, wppm | 0.30 | 0.20 |
| Percent Reduction in Equivalent Nickel Content of VGO | Negligible | — |

It should be noted that the atmospheric residuum used in these tests contained organo-sulfur compounds. Thus, the presence of organo-sulfur compounds in the petroleum feedstock processed even in combination with heat treatment is ineffective in significantly reducing the metals content of the vacuum gas oil.

While the invention has been described with respect to a specific embodiment, it will be understood that this disclosure is intended to cover any variations, uses or adaptations of the invention including such departures from the present disclosure as come within known or customary practice in the art to which the invention pertains and as fall within the scope of the invention.

What is claimed is:

1. A method for reducing the metal contaminant concentration in distillate derived by processing a bottoms fraction from an atmospheric separation where the bottoms fraction contains metal contaminant, said method comprising:

A. passing the bottoms fraction into a contacting zone maintained at a temperature ranging between about 200° C. and about 450° C. and contacting the bottoms fraction therein with one or more metal devolatilization agents selected from the group consisting of vapor phase sulfur dioxide and precursors of vapor phase sulfur dioxide so that the concentration of sulfur dioxide in the contacting zone ranges from about 0.5 to about 5.0 wt.% of the bottoms fraction; and B. passing the bottoms fraction from the contacting zone into a vacuum separation zone wherein the bottoms fraction containing the metal contaminant is separated into a distillate having a relatively low metal contaminant concentration and a bottoms having a relatively high metal contaminant concentration.

2. The method of claim 1 wherein the metal devolatilization agent is a non-halogen containing devolatilization agent selected from the group consisting of sulfur dioxide and sulfur dioxide precursors.

3. The method of claim 1 wherein the metal devolatilization agent is selected from the group consisting of sulfur dioxide, sulfurous acid, ammonium bisulfite and alkali metal bisulfites.

4. The method of claim 1 wherein the bottoms fraction from the contacting zone is separated into a distillate having a relatively low metal contaminant concentration and a bottoms having a relatively high metal contaminant concentration without the addition of solvent to the fraction.

5. The method of claim 1 wherein the distillate has a cut point of at least 520° C.

6. The method of claim 5 wherein the distillate has a cut point of at least 565° C.

7. The method of claim 6 wherein the distillate has a cut point of at least 590° C.

8. The method of claim 5 wherein the metal contaminant comprises nickel.

9. The method of claim 8 wherein the metal contaminant further comprises vanadium.

10. The method of claim 9 wherein the metal devolatilization agent comprises sulfur dioxide.

11. The method of claim 10 wherein the contacting zone is maintained at a temperature ranging between about 250° C. and about 400° C.

12. The method of claim 10 wherein the bottoms fraction is contacted with about 0.5 to about 5.0 weight percent sulfur dioxide, based upon the weight of the petroleum fraction.

13. The method of claim 12 wherein the bottoms fraction is contacted with about 1 to about 3 weight percent sulfur dioxide, based upon the weight of the bottoms fraction.

14. The method of claim 12 wherein the residence time of the bottoms fraction in the contacting zone ranges between about 0.01 and about 5 hours.

15. The method of claim 14 wherein the absolute pressure at the top of the vacuum separation zone is maintained between about 10 and about 100 mmHg.

16. A method for reducing the concentration of nickel and vanadium in distillate derived by processing a bottoms fraction from an atmospheric separation where the bottoms fraction contains nickel and vanadium, said method comprising:

A. passing the bottoms fraction into a contacting zone maintained at a temperature ranging between about 200° C. and about 450° C. and contacting the bottoms fraction therein with about 0.5 to about 5.0 weight percent vapor phase sulfur dioxide, based upon the weight of the bottoms fraction for a period of time ranging between about 0.01 and about 5 hours; and B. thereafter passing the bottoms fraction into a vacuum separation zone wherein the petroleum fraction is separated into a distillate having a relatively low concentration of nickel and vanadium and a bottoms having a relatively high nickel and vanadium concentration.

* * * * *